US007654913B2

(12) United States Patent
Chen

(10) Patent No.: US 7,654,913 B2
(45) Date of Patent: Feb. 2, 2010

(54) WELD STRUCTURE OF METAL CLUB HEAD

(75) Inventor: Yung Hsiung Chen, Apia (WS)

(73) Assignee: Well Jet International Co., Ltd., Apia (WS)

( * ) Notice: Subject to any disclaimer, the term of this patent is extended or adjusted under 35 U.S.C. 154(b) by 115 days.

(21) Appl. No.: 12/014,113

(22) Filed: Jan. 15, 2008

(65) Prior Publication Data

US 2009/0178266 A1 Jul. 16, 2009

(51) Int. Cl.
*A63B 53/04* (2006.01)

(52) U.S. Cl. ..... 473/324; 473/342; 473/345

(58) Field of Classification Search ..... 473/324–350; 29/525.14, 466

See application file for complete search history.

(56) References Cited

U.S. PATENT DOCUMENTS

| | | | | | |
|---|---|---|---|---|---|
| 5,232,224 | A * | 8/1993 | Zeider | 473/345 |
| 5,294,037 | A * | 3/1994 | Schmidt | 228/125 |
| 5,303,922 | A * | 4/1994 | Lo | 473/330 |
| 5,405,137 | A * | 4/1995 | Vincent et al. | 473/342 |
| 5,505,453 | A * | 4/1996 | Mack | 473/329 |
| 5,538,798 | A * | 7/1996 | Sheehan | 428/577 |
| 5,704,850 | A * | 1/1998 | Shieh | 473/324 |
| 5,718,641 | A * | 2/1998 | Lin | 473/224 |
| 6,033,318 | A * | 3/2000 | Drajan et al. | 473/309 |
| 6,299,549 | B1 * | 10/2001 | Shieh | 473/342 |
| 6,780,124 | B2 * | 8/2004 | Lu | 473/342 |
| 7,160,204 | B2 * | 1/2007 | Huang | 473/342 |
| 7,396,291 | B2 * | 7/2008 | Lo | 473/324 |
| 7,413,517 | B2 * | 8/2008 | Butler et al. | 473/288 |
| 2003/0013548 | A1 * | 1/2003 | Kouno | 473/345 |
| 2007/0105657 | A1 * | 5/2007 | Hirano | 473/345 |
| 2008/0220894 | A1 * | 9/2008 | Matsunaga et al. | 473/346 |
| 2008/0261720 | A1 * | 10/2008 | Matsunaga et al. | 473/345 |

* cited by examiner

*Primary Examiner*—Sebastiano Passaniti
(74) *Attorney, Agent, or Firm*—Leong C. Lei

(57) ABSTRACT

A golf club head is formed with openings respectively on top and bottom sides thereof and a circumferential recessed groove is formed in the club head along a circumference of each opening. Pegs are formed in and spaced along the circumferential grooves. A faceplate and a bottom plate are provided, each having a circumferential edge along which notches are formed in a spaced manner to correspond to the pegs. Thus, when the faceplate and the bottom plate are received in the top and bottom openings respectively to be supported by the circumferential grooves, the notches respectively snugly fit over the pegs to thereby securely and properly hold the faceplate and the bottom plate in position for subsequently welding operation. Thus, the subsequent welding operation can be carried out in a smooth manner without any underside shifting of the faceplate and bottom plate with respect to the club head.

2 Claims, 6 Drawing Sheets

WELD STRUCTURE OF METAL CLUB HEAD

BACKGROUND OF THE INVENTION (a) Technical Field of the Invention

The present invention relates to a safety for nailing devices, and in particular to a safety that, unless released, prevents the nailing device from operation by blocking a nail striker plate, in order to ensure operation safety of the nailing device.

(b) Description of the Prior Art

With the progress of the modern industrial and commercial society, people are persistently taking every greater living and economic pressure. This makes the modern working longer than ever, and the time they can have for leisure activity and tours is getting less. Various ways are taken by the modern people to releasing their mental and physical strains. A lot of people take their favorite sports or trips in their leisure hours. Some the sports are exciting ones, but the other are smooth and gentle activities. Among all the sports, golf is prevailing in modern urban people for the golf game is not just a sport that helps exercising physical health, but also a way of establishing and enhancing social relationship with other people by friendly conversation in the long course of a golf game. For a golf player, except skill, a golf club, especially the club head, is also of importance for playing a good game. Thus, every manufacturer is devoted themselves in the development of good club and club head. One of the golf club head is made of metal, of which an example is shown in FIGS. 1 and 2. The conventional metal club head as shown in FIGS. 1 and 2, broadly designated at 1, comprises a body 11 and faceplate 12, which are prepared separately. The body 11 is provided on a top side thereof an opening 13 having a circumference along which a circumferential recessed groove 14 is formed for receiving and accommodating the faceplate 12 therein for covering the opening 13. Also, the surface of the body 11 is provided with erected tabs 15 that are spaced along the circumferential groove 14. When the faceplate 12 is properly set to close the opening 13, the tabs 15 are individually hammered one by one to bend and abut against the faceplate 12 thereby securing the faceplate 12 in position for subsequent wielding operation. Bending the tabs 15 one by one is a very time consuming job and is very likely to cause shifting of the faceplate 12 due to the striking force applied to the tabs 15, which leads to improper positioning of the faceplate 12 and, consequently, poor quality of the club head.

Thus, it is desired to provide a weld structure of club head that overcomes the above drawback.

SUMMARY OF THE INVENTION

The primary purpose of the present invention is to provide a weld structure of a gold club head, which ensure efficient and proper positioning of a faceplate and a bottom plate in the welding of the faceplate and the bottom plate so that high quality product can be made in a short working time.

In accordance with the present invention, a club head is formed with openings respectively on top and bottom sides thereof and a circumferential recessed groove is formed in the club head along a circumference of each opening. Pegs are formed in and spaced along the circumferential grooves. A faceplate and a bottom plate are provided, each having a circumferential edge along which notches are formed in a spaced manner to correspond to the pegs. Thus, when the faceplate and the bottom plate are received in the top and bottom openings respectively to be supported by the circumferential grooves, the notches respectively snugly fit over the pegs to thereby securely and properly hold the faceplate and the bottom plate in position for subsequently welding operation. Thus, the subsequent welding operation can be carried out in a smooth manner.

The foregoing object and summary provide only a brief introduction to the present invention. To fully appreciate these and other objects of the present invention as well as the invention itself all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
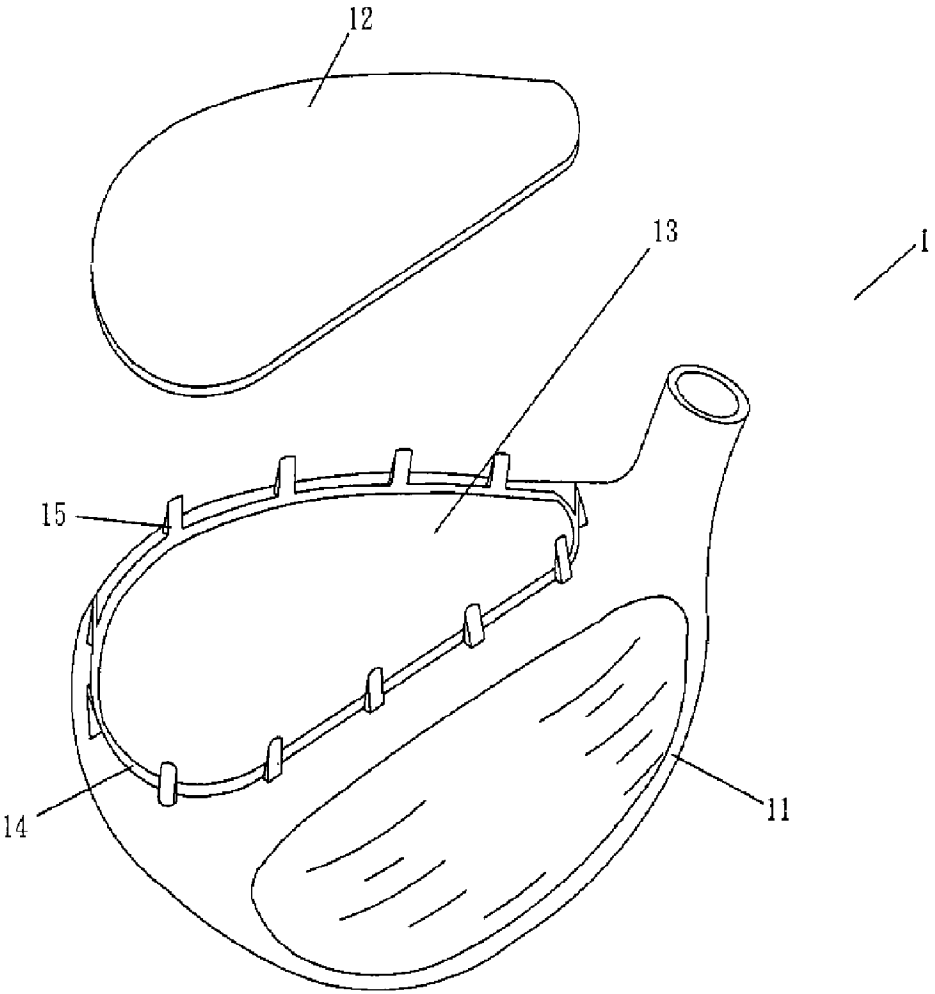
PRIOR ART FIG. 1
FIG. 1 is a perspective view of a conventional golf club head showing a faceplate is separate from a club head before welding operation is taken.
Figure 2:
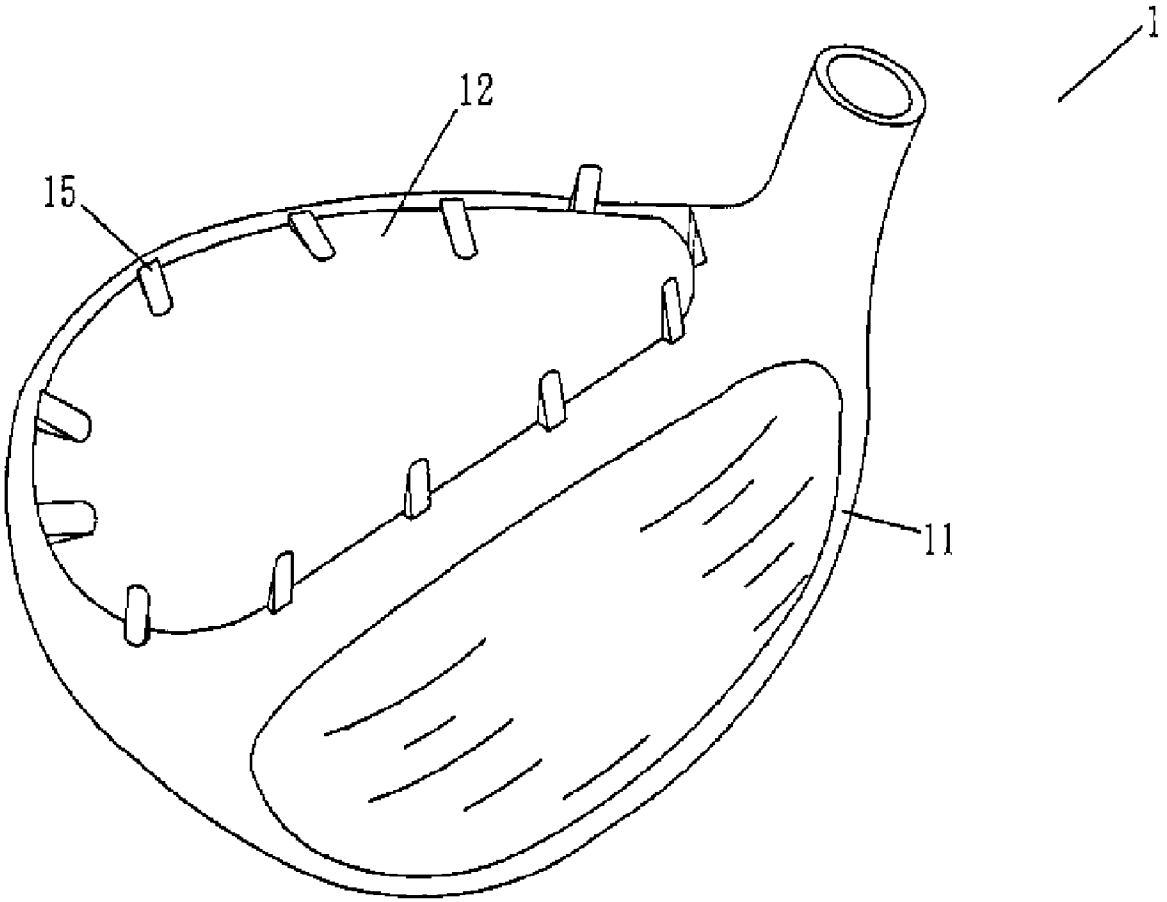
PRIOR ART FIG. 2
FIG. 2 is a perspective view of the conventional golf club head with the faceplate received in an opening of the club head and being secured in position by bending erected tabs that are distributed along the opening.
Figure 3:
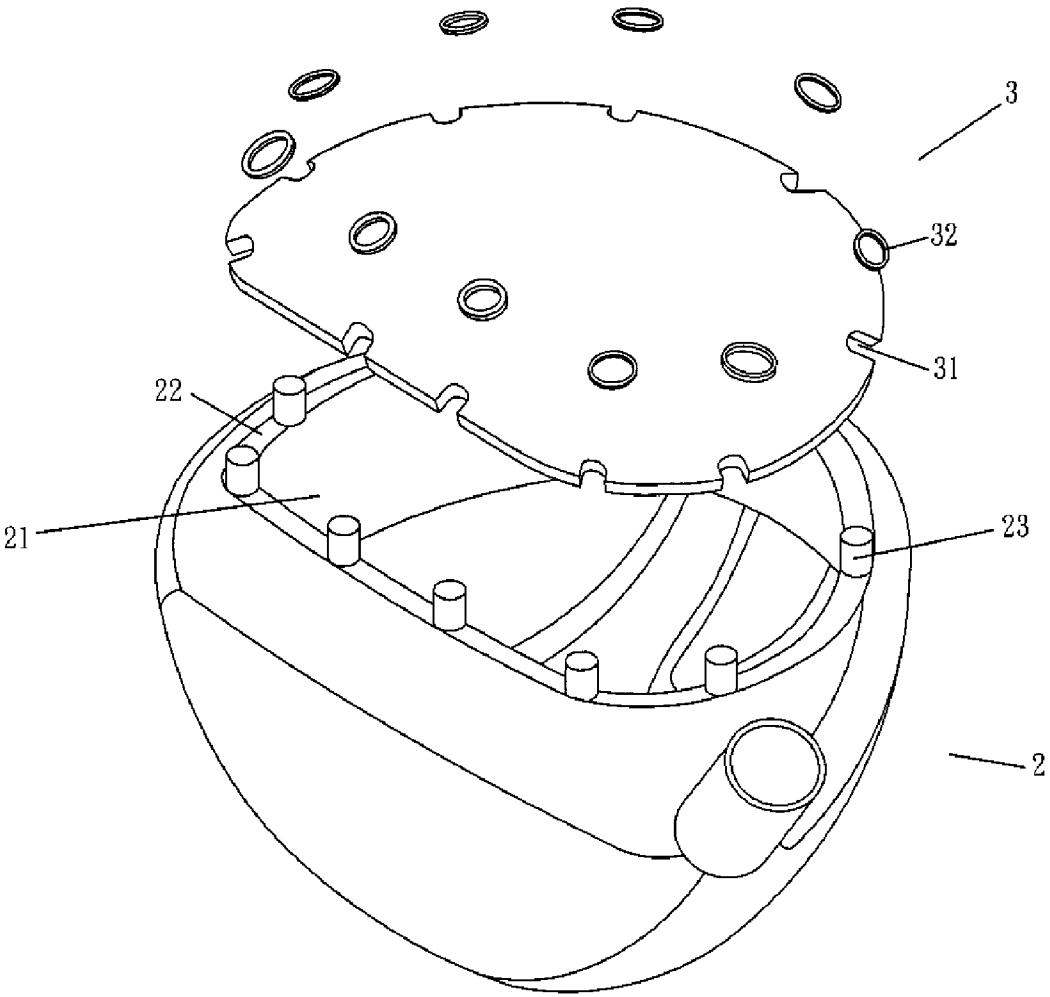
FIG. 3 is a perspective view showing a golf club head constructed in accordance with the present invention with a faceplate separate from the club head before being put to cover an opening of the club head.
Figure 4:
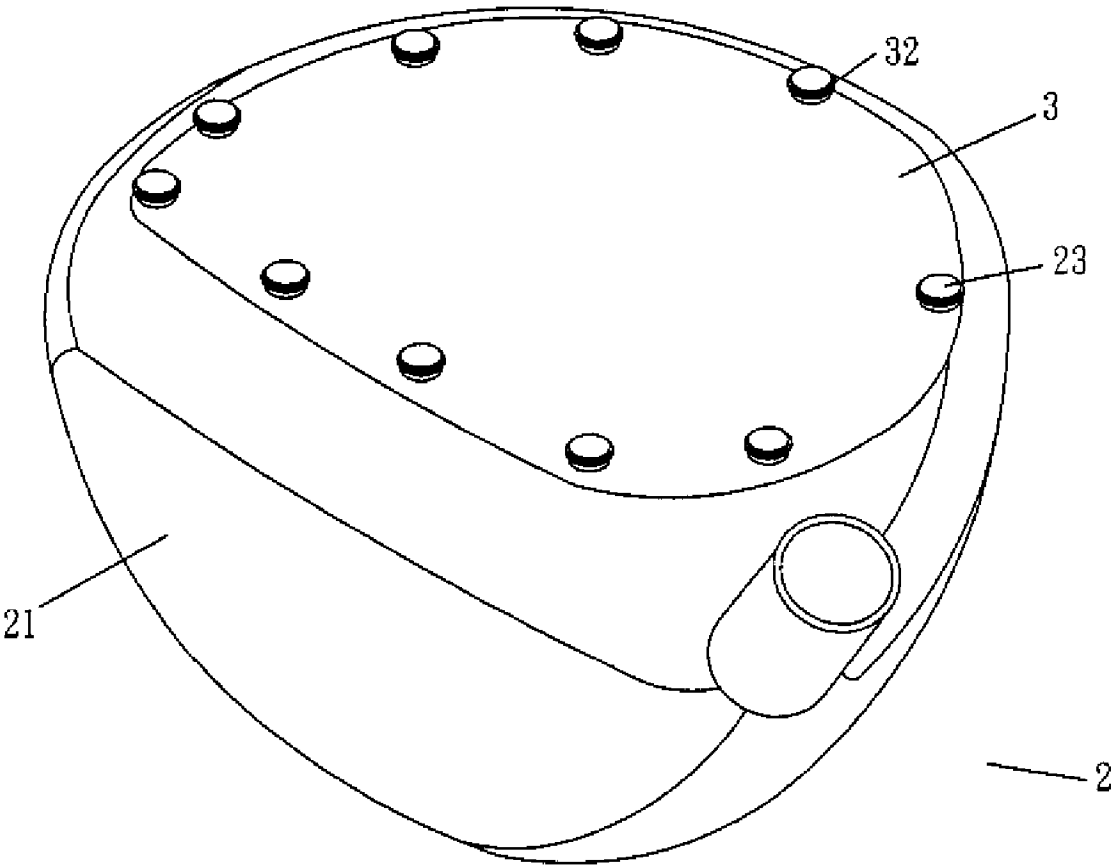
FIG. 4 is a perspective view of the golf club head of the present invention with the faceplate covering the opening and secured in position by pegs of the club head fit into notches defined in the faceplate.

With reference to the drawings, and in particular to FIGS. 3 and 4, the present invention provides a weld structure that allows a faceplate and/or a bottom plate to be efficiently and properly secured to a golf club head. The faceplate is a portion of the club head body that covers an opening in the top surface of the club head body. In accordance with the present invention, as shown in FIGS. 3 and 4, a club head body 2 and a faceplate 3 are prepared separately in advance. The body 2 has an opening 21 formed on a top surface thereof. The body 2 also forms a groove 22 extending along a circumference of the opening 21 and recessed with respect to the top surface of the club head body 2. A plurality of pegs 23 is formed in the groove 22 and is circumferentially spaced top the groove 22. The pegs 23 are of a size to partially project beyond the bottom surface of the club head body 2. The faceplate 3 has a circumferential edge corresponding to the opening 21 of the body 2 and forms a plurality of notches 31 that is distributed along the circumferential edge and corresponding to the pegs 23. Thus, when the faceplate 3 is put into and covers the opening 21 of the club head body 2, the notches 31 of the faceplate 3 are respectively and snugly fit over the pegs 23 of the club head body 2 so that the faceplate 2 is properly positioned and secured with respect to the club head body 2. A ring 32 is then fit over a projecting end of each peg 23.

When the faceplate 3 is set to close the opening 21 of the club head body 2, the notches 31 respectively engage the pegs 23 in a tight and abutting manner so that the faceplate 3 is properly positioned and secured. After the rings 32 are fit to the pegs 23, welding can be carried out on each ring 32. Since the notches 31 tightly abut against the pegs 23, the faceplate 3 is securely fixed against any potential shifting thereby enhancing the subsequent welding operation. In other words, such a weld structure ensures efficient and proper positioning of the faceplate 3 and can save a lot of time, as compared to the conventional structures, thereby providing improved quality and reduced flaw rate.

Figure 5:
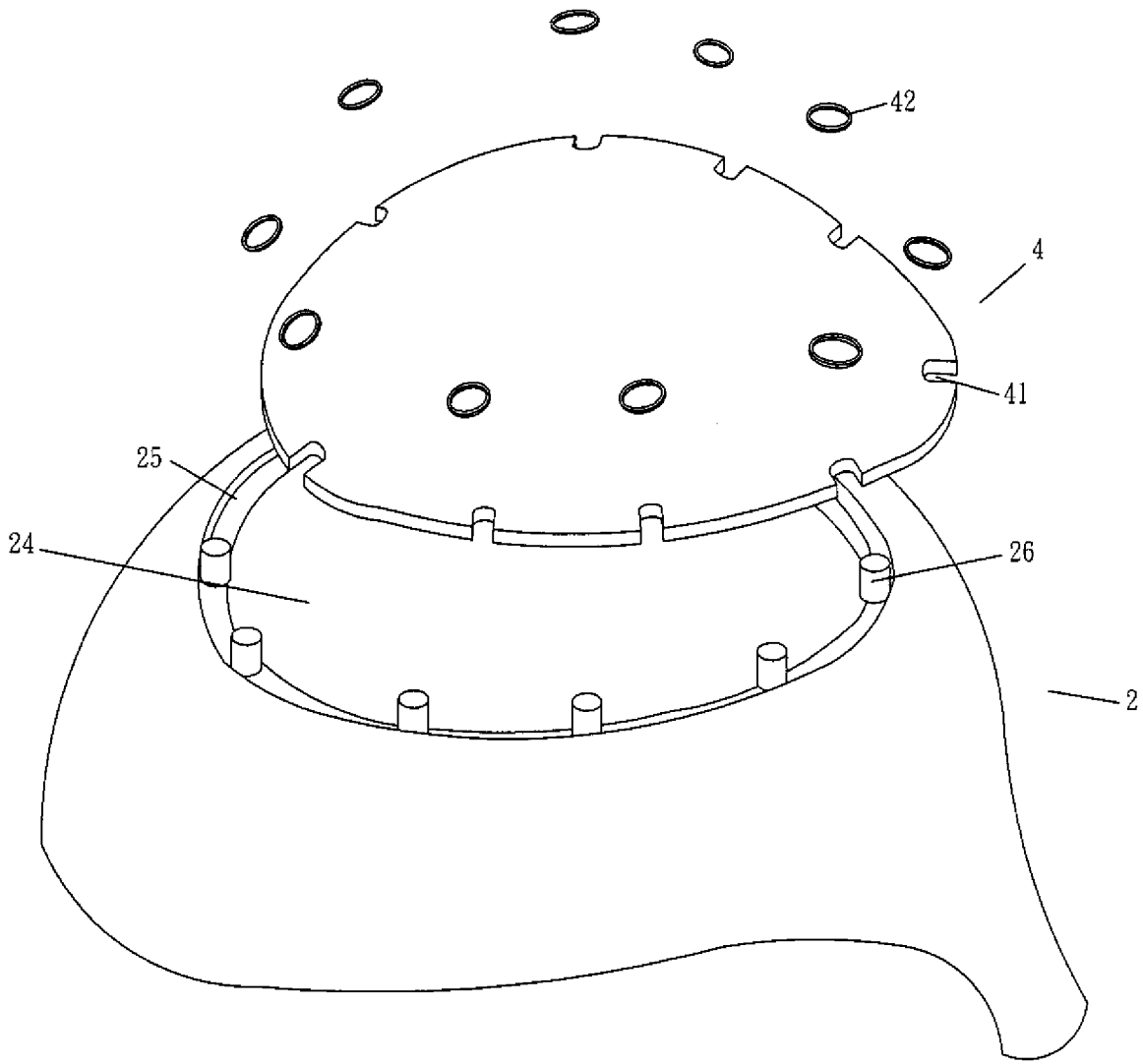
FIG. 5 is a perspective view showing a golf club head constructed in accordance with the present invention with a bottom plate separate from the club head before being put to cover an opening of the club head.
Figure 6:
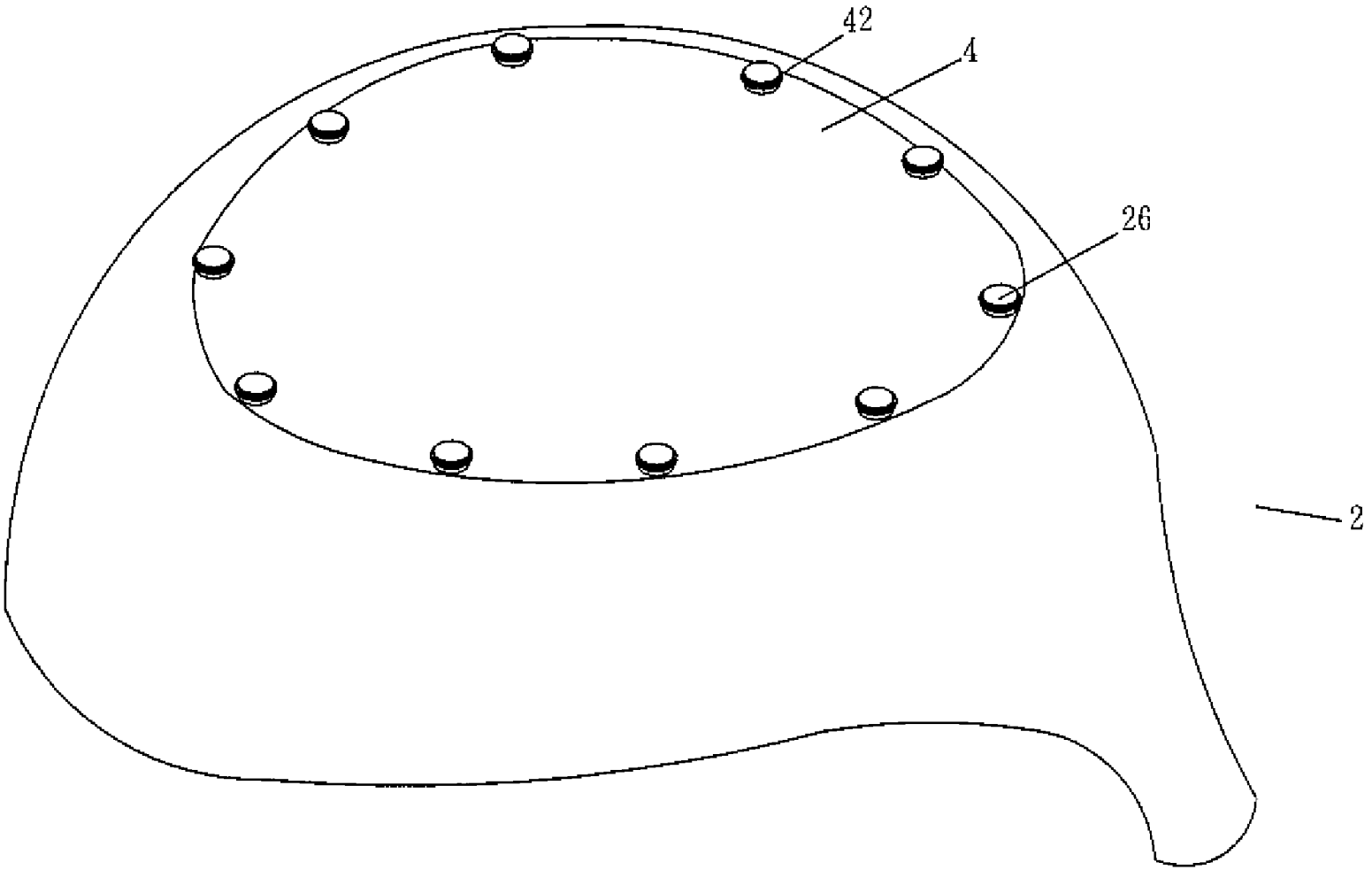
FIG. 6 is a perspective view of the golf club head of the present invention with the bottom plate covering the opening and secured in position by pegs of the club head fit into notches defined in the bottom plate.

Referring to FIGS. 5 and 6, in accordance with another aspect of the present invention, a club head body 2 and a bottom plate 4 are prepared separately in advance. The club head body 2 forms an opening 24 in a bottom surface thereof. The body 2 also forms a groove 25 extending along a circumference of the opening 24 and recessed with respect to the bottom surface of the club head body 2. A plurality of pegs 26 is formed in the groove 22 and is circumferentially spaced along the groove 22. The pegs 26 are of a size to partially project beyond the bottom surface of the club head body 2. The bottom plate 4 has a circumferential edge corresponding to the opening 24 of the body 2 and forms a plurality of notches 41 that is distributed along the circumferential edge and corresponding to the pegs 26. Thus, when the bottom plate 4 is put into and covers the opening 24 of the club head body 2, the notches 41 of the bottom plate 4 are respectively and snugly fit over the pegs 26 of the club head body 2 so that the bottom plate 4 is properly positioned and secured with respect to the club head body 2. A ring 42 is then fit over a projecting end of each peg 26.

When the bottom plate 4 is set to close the opening 24 of the club head body 2, the notches 41 respectively engage the pegs 26 in a tight and abutting manner so that the bottom plate 4 is properly positioned and secured. After the rings 42 are fit to the pegs 26, welding can be carried out on each ring 42. Since the notches 41 tightly abut against the pegs 26, the bottom plate 4 is securely fixed against any potential shifting thereby enhancing the subsequent welding operation. In other words, such a weld structure ensures efficient and proper positioning of the bottom plate 4 and can save a lot of time, as compared to the conventional structures, thereby providing improved quality and reduced flaw rate.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A weld structure of a golf club head comprising a club head body and a faceplate, wherein the club head body forms, on a top surface thereof, an opening and also forms a circumferential groove extending along a circumference of the opening and recessed with respect to the top surface of the club head body, and wherein a plurality of pegs are formed in and spaced along the circumferential groove and the pegs partially project beyond the top surface of the club head body, the faceplate having a circumferential edge along which notches are formed and distributed to correspond to the pegs of the club head body, whereby the faceplate is put into and covers the opening and the notches are fit over and abut against the pegs respectively, with a ring put over a projecting end of each peg for a subsequent welding operation so that no undesired shifting of the faceplate with respect to the club head body occurs in the subsequent welding operation.

2. A weld structure of a golf club head comprising a club head body and a bottom plate, wherein the club head body forms, on a bottom surface thereof, an opening and also forms a circumferential groove extending along a circumference of the opening and recessed with respect to the bottom surface of the club head body, and wherein a plurality of pegs are formed in and spaced along the circumferential groove and the pegs partially project beyond the bottom surface of the club head body, the bottom plate having a circumferential edge along which notches are formed and distributed to correspond to the pegs of the club head body, whereby the bottom plate is put into and covers the opening and the notches are fit over and abut against the pegs respectively, with a ring put over a projecting end of each peg for a subsequent welding operation so that no undesired shifting of the bottom plate with respect to the club head body occurs in the subsequent welding operation.

* * * * *